United States Patent [19]

Ogden

[11] Patent Number: 4,620,753

[45] Date of Patent: Nov. 4, 1986

[54] MULTIPOSITION ADJUSTMENT ARRANGEMENT FOR CABINET MOUNTING OF DOMESTIC APPLIANCES

[76] Inventor: Ralph Ogden, 1304 Fisher St., Munster, Ind. 46321

[21] Appl. No.: 800,818

[22] Filed: Nov. 22, 1985

[51] Int. Cl.[4] ..... A47B 81/00

[52] U.S. Cl. ..... 312/29; 312/30; 312/208

[58] Field of Search ..... 312/21, 24, 27–30, 312/208; 248/675

[56] References Cited

U.S. PATENT DOCUMENTS

| | | | |
|---|---|---|---|
| 2,369,069 | 2/1945 | Mowat | 312/29 |
| 2,926,055 | 2/1960 | Mark | 312/21 |
| 4,089,572 | 5/1978 | Flynt et al. | 312/27 |
| 4,201,427 | 5/1980 | Orr | 312/21 |

*Primary Examiner*—William E. Lyddane
*Assistant Examiner*—Joseph Falk
*Attorney, Agent, or Firm*—Mann, McWilliams, Zummer & Sweeney

[57] ABSTRACT

An arrangement for mounting a domestic appliance, such as a machine, within its cabinet that provides, in the case of sewing machine heads, both free arm to storage and flat bed to storage positions as well as a fifth position orienting the sewing machine to permit access to the machine, of side bobbin access type machines, bobbin from the top of the cabinet, with the connection of the appliance head to its cabinet being by way of a pair of fixed oppositely disposed pins at the front side of the assembly and a pair of oppositely disposed retractable pins spaced to the rear of the fixed pins, with the pairs of fixed and retractable pins cooperating with brackets located one each adjacent the respective ends of the head that are anchored to the cabinet, and with the sewing machine being oriented with regard to the fixed and movable pins such that the center of gravity of the sewing machine is located basically between the fixed and retractable pairs of pins, to provide a gravity assist biasing action on the sewing machine in effecting a number of the indicated positions of the sewing machine with respect to its cabinet.

10 Claims, 13 Drawing Figures

MULTIPOSITION ADJUSTMENT ARRANGEMENT FOR CABINET MOUNTING OF DOMESTIC APPLIANCES

This invention relates to the mounting of domestic appliances to and in the cabinet provided with same, for manual positioning of the appliance between the conventional alternate positions of operation and retraction for instance, in the case of sewing machine assemblies, the commonly available domestic sewing machine has free arm and flat bed positions, as well as providing for storage of the sewing machine within its cabinet. More particularly, the invention is directly concerned with providing a five position mounting arrangement for adjustably mounting a domestic sewing machine head within its cabinet, that includes a position, for side bobbin access type machines, which orients the machine to inspect and change the sewing machine bobbin from the top of the cabinet, and that includes the arranging of the mounting arrangement to provide the biasing action on the machine to assist the user in manually shifting the machine between many of its positions with respect to the cabinet.

The familiar domestic sewing machine offered by most merchandisers of this type of product normally includes a cabinet formed from wood or a wood like product, in a quadrilateral shell configuration that includes suitable leg supports in which a head assembly, that includes the sewing machine proper, is mounted in the cabinet for manual positioning between operationing and retracted positions. The sewing machine head and its cabinet provide a sewing machine assembly having a front side at which the user sits to operate the machine, when the machine is in one of its operating positions, a rear side that is opposite of the front side, and right and left sides that correspond to the user's right and left arms.

The assembly cabinet normally includes a top that includes one or several cover leafs hinged or otherwise secured to the cabinet so as to be swung or otherwise moved to one side to expose the sewing machine head that is contained within the cabinet through the then open top of the cabinet, with the sewing machine head being disposable in a retracted position when the cabinet is to be closed, as by having its top leaf or leaves swung to cover the open top of the cabinet.

Domestic sewing machines employed to form the head of this type of appliance fall into two basic types, namely the older larger more expensive top bobbin access type, and the newer, less expensive, and now widely popular front side bobbin access type. The head mounts for both types of machines, for adjustably mounting the sewing machine within its cabinet, to position the sewing machine when the latter is to be used, have provided the machine user with two sewing machine operating positions, namely the familiar upper free arm position, and the familiar lower flat bed position, as well as a storage position in which the sewing machine is disposed within the cabinet so the cabinet cover, usually the top of the cabinet can be applied over the top of the cabinet to mask the machine, whereby the cabinet may have the appearance of a piece of decorator furniture, or used as a desk or a table. The flat bed position is the operative position most used, as the free arm position is basically used only when working on tubular fabric structures such as fabric clothing piece intended to cover an arm or a leg. Domestic sewing machines of the types indicated are conventionally equipped with a removable fabric support on the front side of the machine head that is left in place and used when the head is in its flat bed position, but which is removed when the head is in the machine free arm position.

A principal object of the present invention is to arrange the mounting of the appliance, for instance a domestic sewing machine, within its cabinet so that the weight of the sewing machine head itself aids the user in manually shifting the machine between its operating and retracted positions.

Another principal object of the invention is to arrange the mounting of the appliance within its cabinet for movement between, with reference to sewing machine heads the now standard free arm and flat bed operating positions, as well as a storage position to which the machine may be directly moved from each of the indicated operating positions and also provide an alternate fifth position, especially adapted for heads having front side access type sewing machines, in which the sewing machine is slanted upwardly toward the user (when at the front of the machine), to permit the user to have direct access to the machine bobbin through the top of the cabinet.

Yet other objects of the invention are to provide a multipurpose gravity assisted manually operable mounting arrangement for shiftably mounting domestic appliances, such as the domestic sewing machine, within its cabinet, that, in addition to providing the indicated five alternate positions, is economical of manufacture, convenient to use and operate, and long lived in use.

In accordance with the invention, a domestic appliance assembly is provided that is embodied, in the instant disclosure in a domestic sewing machine assembly that includes the familiar parallelepiped base, formed from wood or other suitable material, on which the sewing machine (which may be of any suitable make) is suitably mounted or affixed to form the familiar sewing machine head, the familiar quadrilateral cabinet shell in which the sewing machine head is mounted, that has an open centered top that is closed by a suitable cover swingably or otherwise mounted on the cabinet for movement between a sewing machine masking position (when the sewing machine is retracted within its cabinet) and a sewing machine exposing position, in which the cabinet cover leaf or leaves may be disposed to one side of the cabinet when the sewing machine is to be used. The cabinet shell defines the usual sewing machine assembly support legs as well as the assembly front side, the assembly opposite rear side, and the assembly right and left sides, with respect to the position at the front of the assembly that is to be occupied by the user of the sewing machine when the sewing machine is to be operated.

As indicated, the sewing machine itself is suitably affixed to its parallelepiped base (to form the sewing machine head), which base is shaped to be received within the cabinet shell adjacent the front of the assembly, and extends between the right and left sides of the cabinet and longitudinally of the machine. The sewing machine base is freely received within the top of the cabinet and is, in accordance with the invention, operably connected to the right and left sides of the cabinet on the inside of same, to be disposed or positioned in the familiar upper free arm operating position, or in the lower familiar flat bed operating position, and retracts within the cabinet so that the cabinet cover may be positioned to mask the sewing machine. In the latter position, the sewing machine head rests against a suitable support that in the preferred form comprises a shelf suitably fixed within the cabinet adjacent the rear of same and serves to hold the appliance head in an inoperable retracted position disposed wholly within the cabinet.

In accordance with the invention, the indicated sewing machine base has a pair or set of aligned fixed projecting pins anchored to the base at the front of the base, and adjacent the right and left sides of the base, with one of the fixed pins projecting from the right end of the base, and the other of the fixed pins projecting from the other end of the base; the base also has mounted thereon and positioned rearwardly of the fixed pins, a pair or set of aligned retractable pins, with one of the retractable pins projecting from the right hand end of the base, and the other of the retractable pins projecting from the left hand end of the base. The indicated fixed and retractable pins are disposed, in a preferred embodiment, in coplanar relation and lie in a plane that is parallel to the plane of the machine base; the sets or pairs of fixed and retractable pins for any such head are a predetermined fixed distance apart.

It is preferred that the sewing machine be suitably anchored to its base so that the center of gravity of the machine and base is roughly positioned to be vertically above and between the indicated two sets of pins.

The fixed and movable pins at either end of the machine base project outwardly of the base and cooperate with right hand and left hand support brackets that are respectively anchored to the right hand and left hand sides of the cabinet adjacent its upper end. The brackets are disposed in confronting relation and each defines a front wall that is apertured or shaped to define cam surfaces in which the respective fixed and retractable pins operate or are moved for manual shifting of the sewing machine head between the indicated five positions of operation, namely the higher free arm operating position, the lower flat bed operating position, a retracted position from each such operating position in which the sewing machine head rests within the cabinet against a stop structure, such as a shelf-like support that is suitably affixed to the rear wall of the cabinet; the fifth position is a bobbin position in which the sewing machine base is inclined upwardly at an angle approximately 45 degrees and is positioned for the user of the front bobbin access type machines to inspect and change the bobbin as needed from the top of the machine without the user having to move from usual machine operating position at the front of the machine.

The indicated confronting brackets at their vertical walls define mirror image cam surfacings for the respective fixed and retractable pins, with the cam surfacings of each bracket for the respective fixed pins (to be controlled by same) comprising a single closed perimeter slot including an upper horizontal portion extending rearwardly of the base and at its rear portion connecting with a forwardly extending downwardly curved, curvilinear slot stem portion, which together comprise a closed perimeter fixed pin cam surfacing for the indicated fixed pins.

The respective support brackets for the respective retractable pins, at their respective vertical walls, define an upper closed perimeter horizontal slot that is substantially level with the bracket fixed pin upper horizontal slot portion, and a lower, separate, closed perimeter curvilinear slot that has its upper end below the retractable pin closed perimeter upper horizontal slot, and vertically aligned with the rear end of such upper closed perimeter slot, which lower slot is in the nature of a stem that arcs downwardly and forwardly and at the level of the pin seat defined by the fixed pin slot stem portion, defines a rearwardly and downwardly extending toe portion that terminates in a retracting pin seat.

As indicated, the sewing machine and associated parts are fixed to the indicated base that mounts the fixed and retracting pins in such a manner that the center of gravity of the sewing machine head is to be, generally speaking, vertically disposed above and between the respective sets of fixed and retractable pins, which introduces a gravity induced bias on the sewing machine head for assisting in the manual positioning of same between its upper free arm position and its lower flat bed position and from each of said positions and a retracted position. In the upper free arm position the fixed and retractable pins are disposed in pin seats of the respective horizontal slots or slot portions, while in the lower flat bed position the fixed and retracting pins are disposed at the lower ends of the respective bracket stem like slots. From each of these operating positions, the retractable pins may be retracted to permit the sewing machine to rotate about the fixed pins to a retracted position in which the upper portion of the sewing machine engages the rest applied to the rear panel of the cabinet, from which retracted positions the machine may be manually moved by the user to dispose it in one of the indicated operating machines using the procedure outlined hereinafter.

For putting the sewing machine head in its indicated bobbin position, where the sewing machine is of the front side bobbin access type, it may be first positioned in the flat bed position, after which it is tilted rearwardly to the point that the sewing machine moves head is upwardly inclined about forty-five degrees, in which position the fixed pins engage horizontal walls that are an integral part of the respective brackets involved to hold the head in the indicated bobbin position. On removal of the head removable head shelf (that serves as a flat fabric support in the flat bed manner of operation), if this has not yet been done, the appliance user has direct access to the bobbin through the conventional bobbin chamber cover plate; after the bobbin has been attended to the head may be returned to one of its operating or retracted positions, as desired.

Other objects, uses and advantages will be obvious or become apparent from a consideration of the following detailed description and the application drawings, in which like parts are indicated by corresponding reference numerals.

In the drawings:

FIG. 1 is a frontal perspective view of a sewing machine assembly arranged in accordance with the present invention, taken from the front and left hand corner of same and showing the top access type sewing machine illustrating the appliance disposed in its free arm operating position, but with its removable flat fabric support shelf in place (as when the head is in its flat bed position);

FIG. 2 is a side elevational view of the sewing machine assembly, taken from the left hand side of FIG. 1, with parts broken away to expose the sewing machine base and the right hand bracket for supporting same as well as the base fixed and retractable pins and the bracket slots of the right hand bracket that form the camming surfacing for each base pin at that end of the assembly, with the sewing machine removable shelf omitted (it being normally removed for free arm use of the sewing machine);

FIGS. 5–8 are diagrammatic views of the sewing machine assembly in which the sewing machine head is shown in broken lines and indicating the head flat bed operating position (FIG. 7), an intermediate position (FIG. 6), and the head two retracted positions as moved from its two operating positions (FIGS. 5 and 8) with respect to its cabinet that the instant mounting arrangement provides for;

Figure 9:
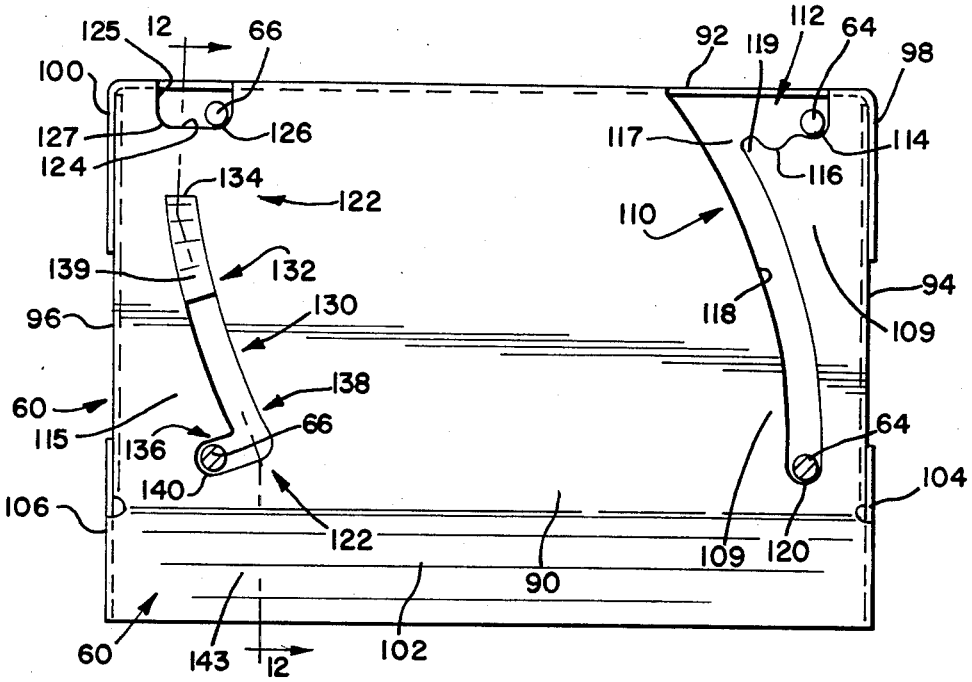
Figure 10:
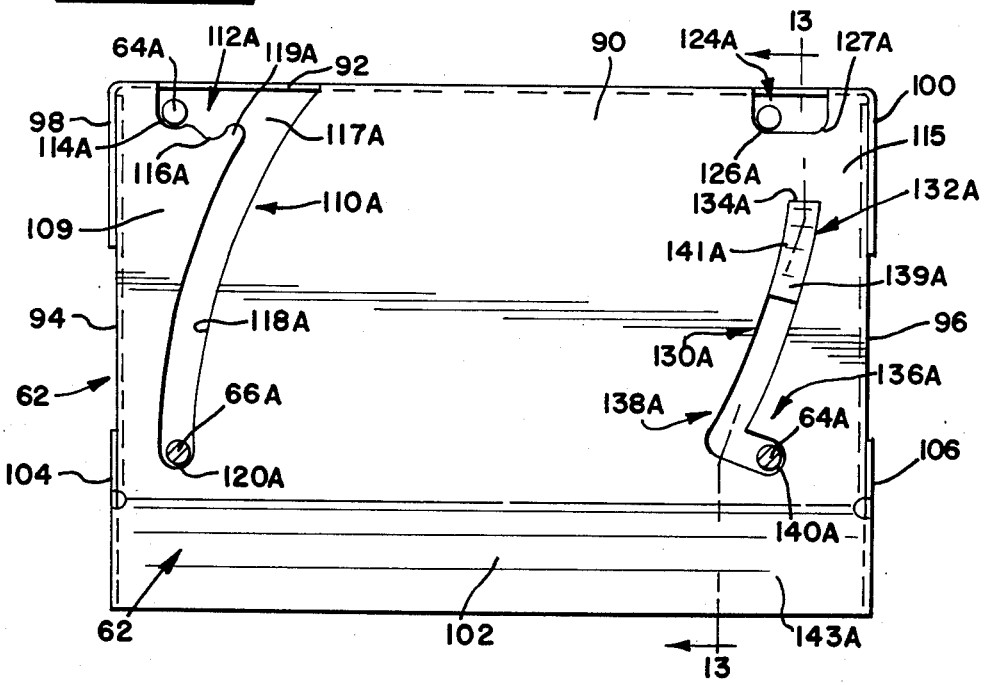
Figure 11:
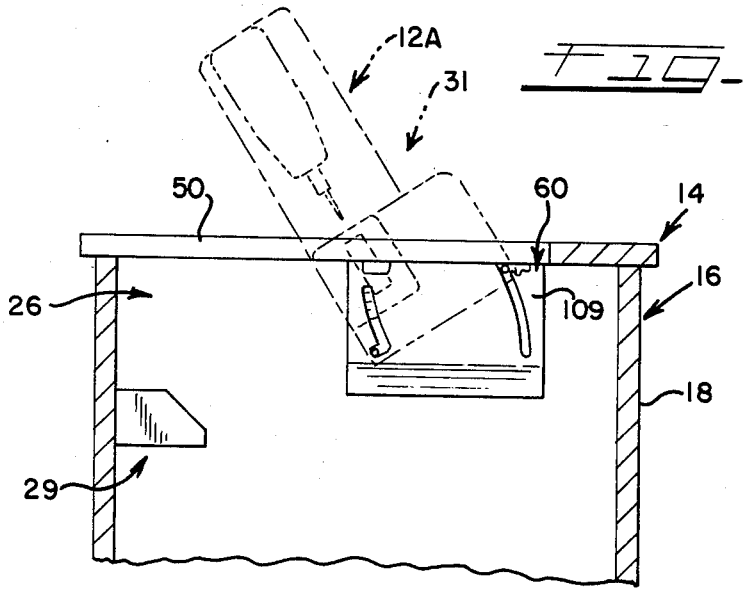
Figure 12:
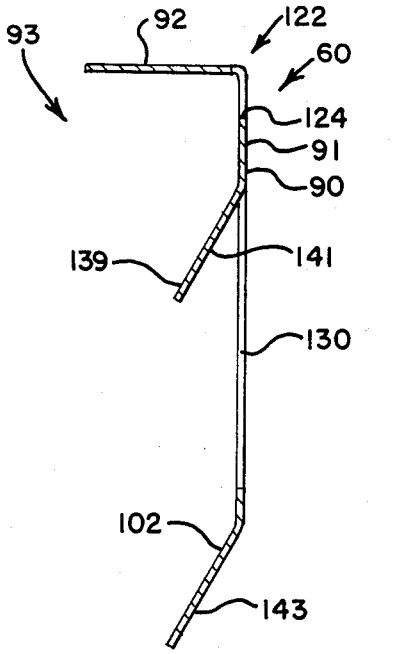
Figure 13:
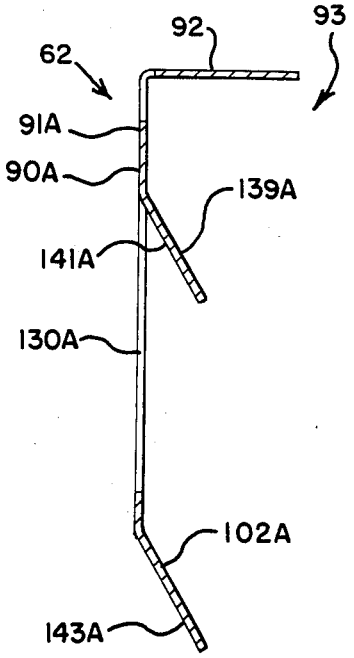

FIG. 9 is a plan view of the right side bracket, on an enlarged scale, and more particularly illustrating the cam and wall surfacing that is provided by the right side bracket slots for the respective fixed and retractable pins, and also indicating the two operating positions of the sewing machine that are provided for by the mounting arrangement of the present invention, with the free arm position being indicated by the elevational view showing of the respective fixed and retractable pins, and the flat bed position being indicated by the sectional view showing of the respective fixed and retractable pins;

FIG. 10 is similar to FIG. 9 but shows the bracket and pins that are applied to the left side of the assembly cabinet;

FIG. 11 is a view similar to those of FIGS. 5–8, but illustrating the front side bobbin access type head disposed in its bobbin access position, with the head removable support shelf shown applied to the head;

FIG. 12 is a vertically sectional view through the appliance assembly right hand bracket, as viewed along line 12—12 of FIG. 9; and FIG. 13 is a view similar to that of FIG. 12, but is taken along line 13—13 of FIG. 10.

However, it is to be understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL AND SPECIFIC DESCRIPTION

Figure 2:
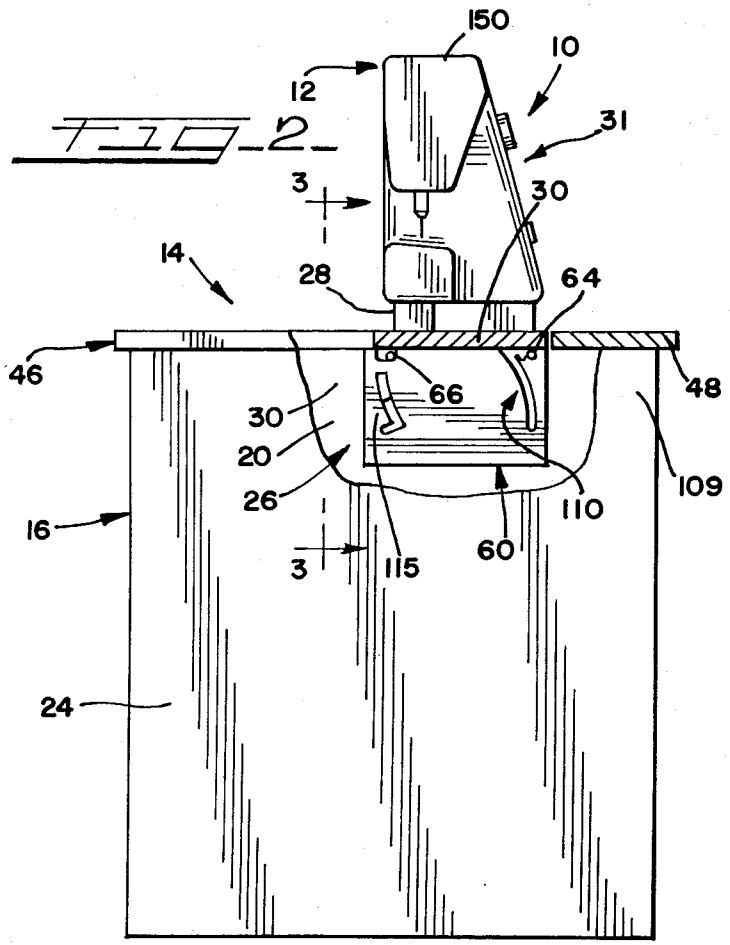
Figure 1:
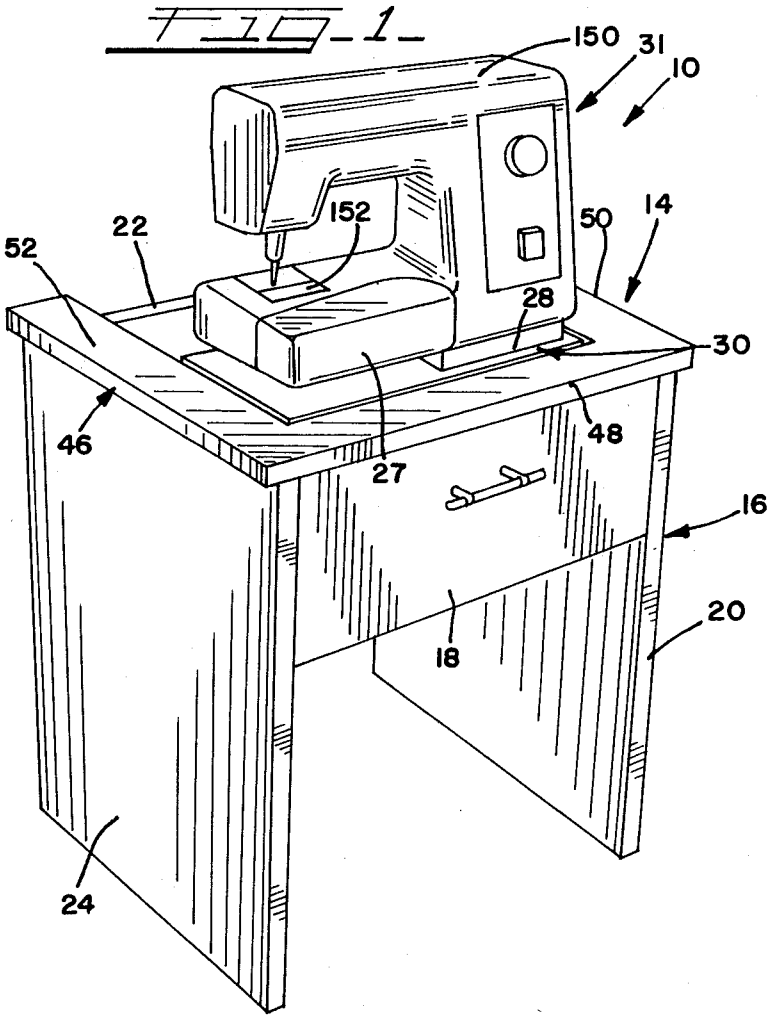

Reference numeral 10 of FIGS. 1 and 2 generally indicates a domestic sewing machine assembly of the top bobbin access type arranged in accordance with the present invention. Assembly 10 includes sewing machine 12 that may be of any type or make offered consumers that is of the top bobbin access type; machine 12 is applied to the usual cabinet 14 that conventionally comprises a quadrilateral shell 16 defined by a front panel 18, the right side panel 20, a rear panel 22, and left hand side panel 24 fixed together to define the usual quadrilateral sewing machine receiving and mounting chamber 26. The sewing machine includes the usual lower foot portion 28 that is suitably anchored, as by applying suitable securement screws or the like (not shown), to quadrilateral base 30 to form the familiar appliance head 31. Machine 12 is conventionally equipped with removable shelf 27 that is removed for free arm use of the appliance, as is conventional. The shelf panels 20 and 24 are proportioned lengthwise to act as the legs of assembly 10 to support the sewing machine appliance at the usual spacing above the floor (not shown) on which assembly 10 rests in normal use.

Figure 3:
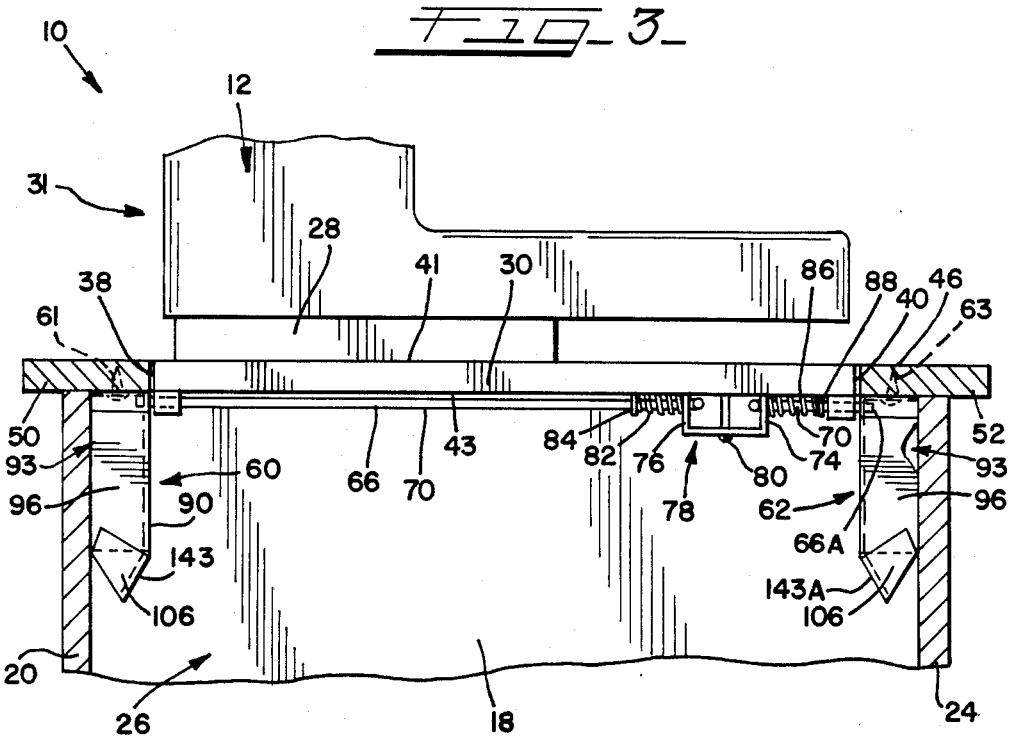
FIG. 3 is a diagrammatic vertical sectional view through the assembly shown in FIG. 2 on a somewhat enlarged scale.
Figure 4:
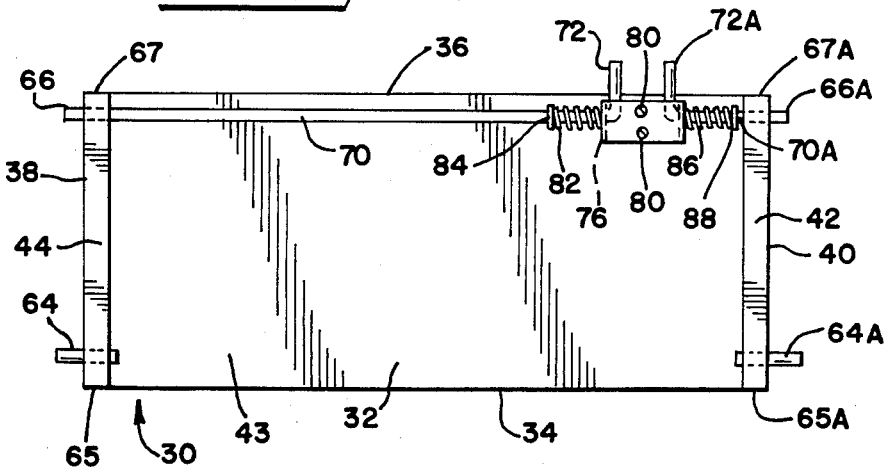
FIG. 4 is a bottom plan view of the sewing machine assembly base and associated fixed end retractable pins.
Figure 6:
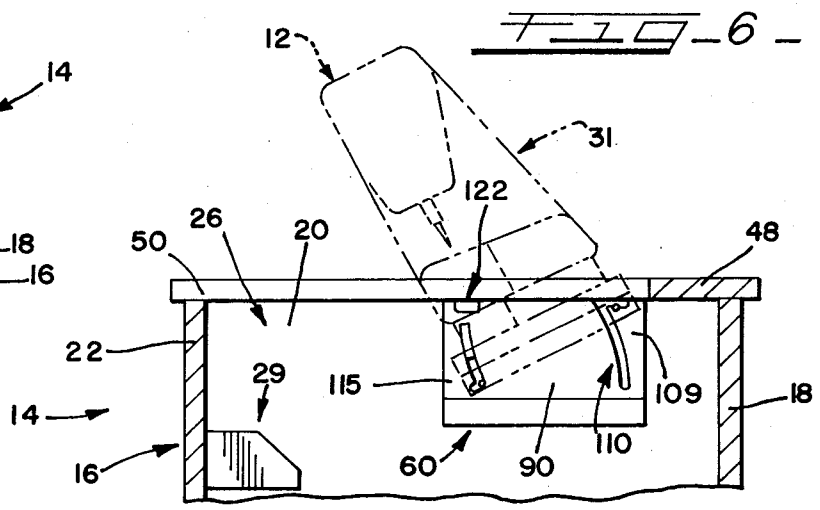

As indicated in FIGS. 3 and 4, the base 30 comprises plate member 32 that is of quadrilateral parallelipiped configuration and may be formed from wood or the like, and defines front side 34, rear side 36, right hand end 38 and left hand end 40 and top and bottom surfaces 41 and 43. Suitably secured to the bottom or underside 43 of the plate 32 at its respective ends 38 and 40 in the illustrated embodiment are the respective cross bars or ribs 42 and 44 that extend transversely of the base 30. Plate member 32 may be formed from any suitable material, but it should be relatively rigid against the bending and torsional stresses to be applied to it by the practice of this invention.

The cabinet 14 that is illustrated includes a top section 46 that is of open centered configuration for application to and about the upwardly facing edges of the cabinet panels 18, 20, 22 and 24 of a suitable cover 25, with the top piece 46 thus defining front section 48 and rearwardly extending side sections 50 and 52 which are spaced from each other to open the chamber 26 to the top of the cabinet 14, when the usual cover (not shown) is removed when assembly 10 is to be used. It is to be understood that when the sewing machine 12 is disposed in one of its retracted positions, a suitable cover within which such assemblies are conventionally equipped, is applied across the top of the assembly 10 to mask the retracted machine 12, and permit the assembly 10 to be used as a desk or table; the cover commonly is in the form of one or several leaves suitably hinged to the assembly to perform the masking function indicated when the assembly is not in use.

The rear panel 22 of cabinet 14, in the embodiment illustrated, has on its inside surfacing a suitable shelf structure or stop 29 suitably affixed thereto against which the sewing machine head 31 is to rest in its retracted positions.

The manner of mounting of the sewing machine head 31 on and with respect to cabinet 14 is effected in accordance with this invention, is concerned with providing a right hand side bracket 60 that is suitably anchored to the cabinet 14 at the cabinet right hand side, as by employing suitable screws 61, (see FIG. 3) therebetween, which are indicated by reference numeral 61, and providing a left hand side bracket 62 at the left hand side of the cabinet 14, which is suitably anchored thereto as by employing suitable screws 63 (see FIG. 3) therebetween. In the illustrated embodiment the brackets 60 and 62 are fixed by the respective sets of screws 61 and 63 to the respective top piece side sections 50 and 52 prior to the top piece 46 being suitably affixed to the top of shell 16, and at the positions the respective brackets 60 and 62 are to have relative to cabinet 14 and head 31 in accordance with the invention. Top section 46 is fixed in place on cabinet 14 in any suitable manner (not shown), as by employing screws or the like.

The brackets 60 and 62 will be further described in detail as the disclosure proceeds.

Further, the base 30 itself is provided on its underside 43 with a pair of fixed pins 64 and 64A that are fixedly mounted in aligned coaxial relation adjacent the forward ends 65 and 65A of the ribs 42 and 44, as indicated in FIG. 4, while at their rearward ends 67, 67A, the base ribs 42 and 44 mount a pair of retractable pins 66 and 66A that are coaxially aligned and slidably mounted in the respective ribs 42 and 44 to project to the right and to the left of the base 30, and in particular to the right and left of its ribs 42 and 44.

The retractable pins 66 and 66A are similar and comprise (see FIG. 4) elongate rod sections 70 and 70A, respectively, that are respectively integral with right angled handles 72 and 72A, respectively. At the respective ribs 42 and 44 the retractable pin sections 70 and 70A are respectively slidably mounted for movement longitudinally thereof, with the respective rod sections 70 and 70A extending through the sides 74 and 76 of U shaped mounting member 78 that is anchored to the base by suitable fastening pins 80. Helical compression spring 82 is interposed between a disc 84 fixed to the operating rod 70 and the side 76 of the mounting member 78 to bias pin 66 to its extended position of FIG. 4, while helical compression spring 86 is interposed between the disc 88 that is suitably fixed to the rod section 70A and the mounting plate side 74 to bias retractable pin 66A to its extended position of FIG. 4. The respective handles 72 and 72A may be employed to retract the respective pins 66 and 66A toward each other and into the respective base ribs 42 and 44 by drawing such handles 72 and 72A toward each other, but on release of such handles 72 and 72A, the respective retracting pins 66 and 66A are biased to return to their extended positions of FIG. 4. In the illustrated embodiment the retractable pins 66 and 66A are proportioned in length to dispose their respective operating handles 72 and 72A for convenience of hand grasping, by the sewing machine user, adjacent the left hand end of machine 12 as mounted in place in assembly 10.

The fixed pins 64 and 64A, on the other hand, are fixedly mounted in their extended positions shown in FIG. 4, and in any suitable manner. For this purpose they may be glued or otherwise cemented in place, or if the ribs 42 and 44 are formed from metal, they may be welded or soldered into fixed relation with the respective ribs 42 and 44.

Further in accordance with the invention, the respective brackets 60 and 62 are formed to define cam and stop surfacing for the respective fixed pins 64 and 64A, and the retractable pins 66 and 66A, to provide the needed support for the sewing machine head 31 when in its free arm and flat bed operating positions, as well as guidance in accordance with the invention for manually shifting the sewing machine 12 between such operating positions of the sewing machine as well as a retracted position from each such operating position; a sewing machine bobbin access position is also provided for when the machine 12 is of the front side bobbin access type.

The individual brackets 60 and 62 each comprise a plate shaped and formed to define (see FIGS. 9 and 10) a front wall 90, a top wall 92, a front side wall 94 and back side wall 96. The back of each bracket 60 and 62 that faces the respective cabinet panels 20 and 24 is open as at 93, in the illustrated embodiment (see FIGS. 12 and 13).

In the specific form illustrated, the side walls 94 and 96 of the respective brackets 60 and 62 are disposed at right angles to the bracket front wall 90, as is the top wall 92, which has tab ends 98 and 100 that are turned over against the respective side walls 94 and 96 and spot welded in place. The front wall includes an integral depending section 102 that is integral with side pieces 104 and 106, with the front wall depending portion 102 being slanted laterally of the respective brackets 60 and 62 and having side sections 104 and 106 that anchored to the respective bracket sides 94 and 96 (by employing welding or brazing or the like) to brace the respective depending portions 102. As indicated in FIG. 2, the respective brackets 60 and 62 are secured to the top cover section 46, side members 50 and 52, respectively, as by employing appropriate screws 61 and 63, respectively, that may be turned in place using a screw driver applied thereto during assembly through the resulting open lower ends of the respective brackets 60 and 62 (note FIG. 3) which permits adjustment of such screws after the assembly 10 is complete. The number of screws employed to secure the respective brackets 60 and 62 should be more than one and at least several spaced along the length of the top wall 92 of the respective brackets 60 and 62.

As indicated in FIGS. 9 and 10, the front walls 90 of the respective brackets 60 and 62 have formed in same the cam surfacing contemplated by the present invention, in mirror image configuration, for the respective sets of fixed and retractable pins.

In the case of the right hand side brackets 60, for the fixed pin 64 cooperating therewith, the bracket front wall 90 is formed at its forward portion 109 with a continuous closed perimeter slot 110 comprising an upper substantially horizontal portion 112 (see FIG. 9) that has its upper margin defined by the bracket top wall 92, with the bracket front wall 90 and said slot upper portion 112 defining an uppermost seat 114 and an intermediate seat 116 that is intermediate the seat 114 and a hump or finger portion 119 of the wall 90 adjacent the juncture 117 of the slot upper portion 112; slot 110 further forms curvilinear stem portion 118 that arcs forwardly and downwardly of the bracket 60. The slot stem portion 110 terminates at its lower end, and is there shaped to define a lowermost fixed pin seat 120 which is disposed vertically below the uppermost fixed pin seat 114 (see FIG. 9).

On the rear portion 115 of the bracket 60 front wall 90, the bracket 60 is formed to define the retractable pin slotting 122, which comprises an upper closed perimeter horizontal slot 124 that is horizontally aligned with the slot portion 112 of slot 110, and defines retractable pin seat 126 at the front of slot 124 in which pin 66 is received when when the retractable pin 66 is in its free arm position. The slot 124 extends rearwardly of the bracket 60 and is substantially equal in length to the distance that defines at the slot stop wall 125 a retractable pin seat 127 (shown dashed in FIG. 9) that is comparable in shape to pin seat 126, which distance is equal to fixed pin movement between seats 114 and 116 of slot 110.

Below the slot 124 of pin slotting 122 is a closed perimeter curvilinear slot 130, which comprises curvilinear stem portion 132 having a closed perimeter upper end 134 disposed vertically below seat 127 of horizontal slot 124, with the stem portion 132 arcing downwardly and forwardly of the bracket 60, to substantial vertical alignment with seat 126 of slot 124, and juncture with a rearwardly directed toe portion 136 that is at right angles to the lower section 138 of stem portion 132 and defines a retractable pin seat 140 that is substantially horizontally aligned with fixed pin seat 120 defined by slot 110 (see FIG. 9). The front wall 90 within slot 130 is shaped to define a tab portion 139 that is angled sidewise and to the right hand side of assembly 10 to define retractable pin camming surface or face 141 that merges with the vertical face 91 of wall 90. Below seat 140, the slanted portion 102 of wall 90 defines cam surfacing 143.

The front wall 90 of the bracket 62 is formed with similarly contoured and located slotting, on a mirror image basis as indicated by corresponding reference numerals accompanied with the suffix A (see FIG. 10).

A further aspect of the Applicant's invention is that the sewing machine 12 should be applied to its base 30 to form head 31 in such a manner that the center of gravity of head 31, while positioned above the respective brackets 60 and 62, is disposed between the set of fixed pins 64 and 64A, and the set of retractable pins 66 and 66A, in terms of the axes along which such pins move. The exact location of the indicated center of gravity is not critical as such, and is not shown for that reason; however, this aspect of the development creates a gravity induced bias on the sewing machine head that assists the machine user in manually moving it between its indicated operating and retracted positions, and to its bobbin access position where the sewing machine is of the front side bobbin access type, as will be hereinafter described.

It is to be noted that, in addition, the sewing machine mounting arrangement herein disclosed has several important characteristics. Thus, fixed pins 64 and 64A are spaced from the retractable pins 66 and 66A a fixed distance which may lie in the range of from about 4 to about 8 inches (5 inches in a satisfactorily operated embodiment of the invention). Further, the slot stems 132 and 132A are struck on a radius about the center of the seats 116 and 116A, respectively, while the slot stem portions 118 and 118A of slots 110 and 110A are struck on a radius about the centers of seats 140 and 140A, respectively. Also, as to bracket 60, seats 114 and 126 are the same distance apart as seats 120 and 140, and in the case of bracket 62, seats 114A and 126A are the same distance apart as seats 120A and 140A; as indicated, they are mirror image related in location With regard to the manner of operation of the herein disclosed domestic appliance mounting arrangement, the showing of FIGS. 1 and 2 illustrates the sewing machine head 31 in its free arm position, and the showings of FIGS. 9 and 10 that illustrate the right side and left side brackets and their slottings per se, show in elevation the fixed pins 64, 64A and the retractable pins 66, 66A in their free arm positioning seats of the respective slots 110 and 110A (slot portions 112 and 112A, respectively), and slots 124 and 124A, respectively. Thus, in the free arm position fixed pins 64 and 64A engage the respective seats 114 and 114A of the respective slots 110 and 110A, while the retractable pins 66 and 66A engage the respective seats 126 and 126A of the respective slots 124 and 124A; in this position of the retractable pins 66 and 66A, they are in the extended relation of FIG. 4 so that the sewing machine head 31 have a firm four point support (at two positions at either end of the bed 30). The sewing machine user may perform the various sewing operations, while seated at the front of the assembly 10, that are performed when the sewing machine is in the free arm position that is illustrated.

To move the sewing machine head 31 from its free arm position to its flat bed position, the head 31 is moved rearwardly by the user to shift the fixed and movable pins rearwardly of the respective slots 110, 110A and 124, 124A. This results in the fixed pins 64, 64A being shifted, cam style, into seats 116 and 116A of slots 110, 110A, and the retractable pins 66, 66A being shifted to seats 127, 127A, respectively, and thus disposed vertically above the ends 134, 134A of the respective slots 132, 132A. The operator, standing at the front of assembly 10, then appropriately grasping, for instance, with his right hand the top 150 of machine 12, and grasping with his left hand the retractable pin handles 72 and 72A, moves the retractable pin handles 72 and 72A toward each other to retract the respective pins 66 and 66A, and lowers the sewing machine rearwardly and downwardly by gravity to the point where the retractable pins 66 and 66A are below slots 124 and 124A at which point the respective handles 72 and 72A may be released to permit the respective pins 66 and 66A to return to their extended relations of FIG. 4 and engage the vertical faces 91 and 91A of walls 90. As pins 66 and 66A are aligned vertically with the respective slots 132, 132A further lowering of the head 31 about seats 116 and 116A slides them into the respective slots 132, 132A, along cam surfacings 141 and within the respective slots 132 and 132A. The machine 12 is then allowed to move downwardly as guided by the respective slots 132 and 132A acting on pins 66 and 66A until the level of the respective toes 136 and 136A are reached, whereupon the head 31 is allowed to move, under gravity rearwardly and downwardly, with head 31 being guided as needed to shift the fixed pins 64 and 64A upwardly over fingers 119, 119A. When the respective pins 66 and 66A have reached the positions indicated in FIGS. 9 and 10 (the sectioned line positions) they are seated in the respective seats 140 and 140A, and the fixed pins 64 and 64A are aligned with the respective slot portions 118 and 118A; the front side of the sewing machine is then tilted downwardly and forwardly to swing the respective fixed pins 64 and 64A smoothly along stem portions 118, 118A of the slots 110 and 110A to seat the respective pins 64 and 64A in the section lined position indicated in FIGS. 9 and 10, and thus at seats 120 and 120A respectively. This provides the flat bed position of the sewing machine that is diagrammatically illustrated in FIG. 7.

Figure 5:
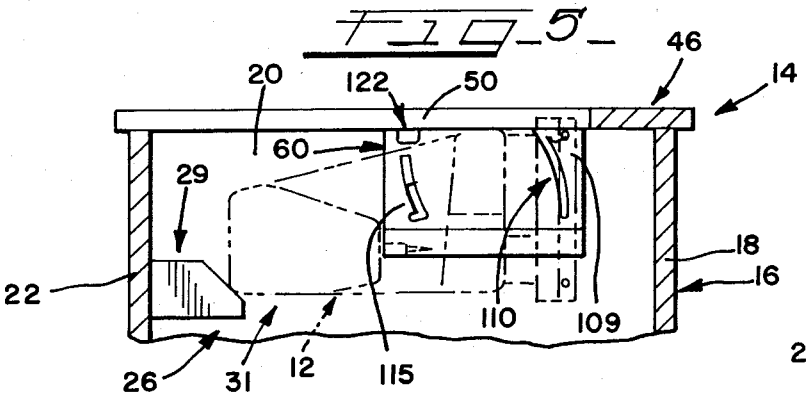
Figure 7:
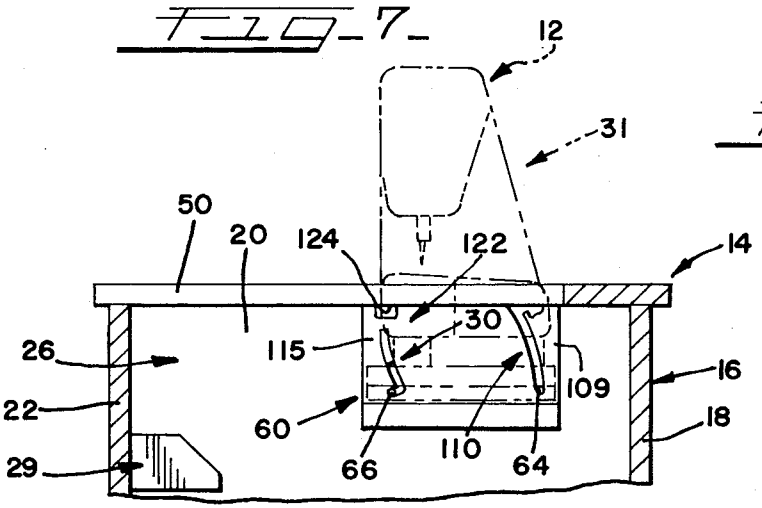

Should the machine operator or user, instead of moving the appliance head 31 from the free arm position of FIG. 2 to the flat bed position of FIG. 7, merely want to dispose the head 31 in a retracted position, the user appropriately grasps the sewing machine, as afore indicated, and leaving the fixed pins 64 and 64A in the respective seats 114 and 114A, moves the respective retractable pins 66 and 66A to their retracted positions, and swings the machine 12 downwardly about the center of the seats 114, 114A to the position of FIG. 5, wherein the top 150 of the sewing machine rests against the cabinet shelf structure or stop 29 (see FIG. 5); when the head has been downwardly rotated in this manner so that pins 66, 66A are below the brackets 60, 62, pin 66, 66A are released to move to their extended positions. Return of the head 31 to its free arm position is effected by reversing the pivoting action just described, with the pins 66, 66A engaging the bracket cam surfacings 143 and 143A to retract them and sliding along the bracket faces 91, 91A until they reach the level of slots 124, 124A, whereupon they snap into.the slots 124, 124A at seats 126, 126A, to effect lodging of the pins 66 and 66A in their extended positions in the respective seats 126 and 126A.

Figure 8:
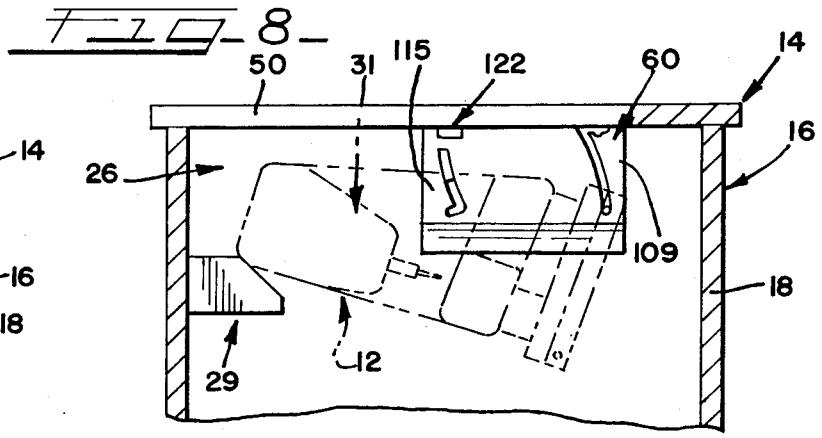

Should the user of the sewing machine merely wish to move the head 31 from its flat bed position to its storage position (see the head position of FIG. 8), leaving the fixed pins 64 and 64A in the respective seats 120 and 120A, the user suitably grasps the machine, as afore indicated, and retracts the retractable pins 66 and 66A and lowers the machine 12 to the retracted position indicated in FIG. 8. Return of the sewing machine 12 to the position of FIG. 7 is provided for by swinging the head 31 upwardly about seats 120, 120A, as a center, with the retractable pins 66, 66A being retracted when they engage the bracket cam surfacings 143, 143A, and then snapping into extended relation at seats 140, 140A.

Should the user desire to inspect or replace the machine bobbin, and machine 12 is of the top bobbin access type the user places the head 31 in either its flat bed position on its free arm position, which disposes the machine 12 for ready access to the bobbin by opening the cover 152 of the machine bobbin compartment. Upon inspection or replacement of the bobbin, the user proceeds to use machine 12 as desired.

Where the machine of head 31 is of the front side bobbin access type 12A (see FIG. 11), the user removes the machine conventional removable shelf 27A to expose the front side access bobbin cover (not shown) of machine 12A. The user then places head 31 in its flat bed position and the tilts it about the axis of the respective seats 140 and 140A to swing the fixed pins 64 and 64A from the respective seats 120 and 120A upwardly of the slot stems 118 and 118A, during the course of which movement the head 31 passes through an over center position (note FIG. 11), with the result that the head 31 is biased rearwardly, about seats 140, 140A, to more fixed pins 64 and 64A through the upper ends of the respective slot stems 118 and 118A and against the respective horizontal walls 92 and 92A of the respective brackets 60 and 62 (see the upper broken line position of the machine 12 in FIG. 13). In this position, in which the head 31 is tilted at approximately 45 degrees to the horizontal, the user of the machine, from the front of the machine, can readily have access to the bobbin compartment of machie 12A, and inspect and replace if necessary, the machine bobbin, after which the bobbin compartment is closed and machine 12A is tilted forwardly to return it to its flat bed position.

Movement of the head 31 from its flat bed position to its free arm position is effected by reversing the head and fixed and movable pin movements that have already been described in connection with shifting of head 12 to its flat bed position from its free arm position. This involves first returning the sets of pins 64, 64A and 66, 66A to their respective seats 116, 116A and 127, 127A, and then shifting the head 34 forwardly to dispose the sets of pins 64, 64A and 66, 66A, in their respective seats 114, 114A and 126, 126.

Of course, where the assembly 10 has a cover or covers of the types indicated, they are shifted as needed to permit the appliance head repositioning desired.

It is pointed out that the retracted positions of the head 31 may be defined by a suitable stop mounted on the inside of the front panel 18, or suitable stop flanges formed on the respective brackets 60 and 62, instead of employing the illustrated rear panel mounted rest 29.

It will therefore be seen that the Applicant's invention is an arrangement for mounting a domestic appliance in its cabinet with the capability of having five positions of the appliance with respect thereto. The mounting arrangement involved provides, for sewing machine appliances, both the familiar free arm and flat bed operating positions of the machine, as well as a separate retracting position from each such operating position. In addition, bobbin inspection and replacement position are also provided for.

In addition, the relationship between the center of gravity of the machine and its base and the fixed and retractable pins that support same from the cabinet, as well as the location and shaping of the bracket slots and case surfaces with which the mounting arrangement fixed and movable pins cooperate, is such that gravity assists the machine user in shifting the machine between many of its possible positions.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an applicance assembly that includes a parallepiped base on which the appliance is mounted, a quadrilateral shell having an open top forming a support for the appliance base, an appliance retracted position rest mounted on one side of the shell and projecting inwardly of same, with the appliance base being received within the shell adjacent the top thereof between the two shell sides that are normal to said one shell side, and means for adjustably mounting the base between said two sides of the shell for movement between upstanding positions at different levels in which the appliance base is horizontally disposed and the appliance is disposed exteriorly of the shell in upright operable positioning, and retracted positions in which the appliance engages the rest and the base is in depending relation from the shell, the improvement wherein:

the mounting of the appliance on the base, and said mounting means, comprises:

the base having a pair of aligned pins fixed to said base adjacent the side of the base that faces away from the rest, with one of said fixed pins projecting from one end of the base and the other of said fixed pins projecting from the other end of the base, with the base having mounted thereon adjacent the other side of the base a pair of aligned retractable pins, with one of said retractable pins projecting from said one end of the base and the other of said retractable pins projecting from said other end of the base, said retractable pins being mounted for movement axially thereof toward each other to dispose them in withdrawn positions relative to the base ends, and including means for resiliently biasing same to their respective projecting positions and handle means for simultaneously moving same to their withdrawn positions, with the appliance being fixed to the base above said pins, and including a first bracket secured to one of the two shell sides between which the base is disposed in supporting relation to those said pins that are at one end of the base, and a second bracket secured to the other of such two shell sides in supporting relation to those of said pins that are at the other end of the base, said brackets each including a vertical wall, with said brackets being secured to said shell in confronting relation, and said walls being in substantial parallelism and each being formed to define slot means in which said pins at either end of the base are received to support the appliance and base from the shell, said slot means of one of said walls being a mirror image of said slot means of the other of said walls, said slot means for each of said walls comprising, for the respective fixed pins, an upper horizontal slot portion having at the end of same projecting away from the one side of the shell a first appliance operating position seat adjacent a vertical stop surface, with said slot upper horizontal portion being open and connected to a curvilinear slot stem portion that arcs downwardly below said slot upper portion to a second appliance operating position pin seat substantially vertically aligned with said horizontal slot portion seat, said brackets each including a horizontal wall rigid with respect to the respective brackets and disposed above said slot means slot portion, said slot means for each of said walls comprising, for the respective retractable pins, an upper closed perimeter horizontal slot that is substantially level with said wall upper horizontal slot portions of said walls for said fixed pins, and having closed ends, with the end of same that is closest to said wall upper horizontal slot portion of the respective brackets forming a first appliance operation position seat, and an elongate curvilinear closed perimeter slot separated from and below the said closed perimeter upper horizontal slot of the respective walls and having its upper end substantially aligned with the other end of said closed perimeter upper slot and arcing downwardly to substantial vertical alignment with said closed perimeter slot seat, and thence defining a toe portion extending away from the wall fixed pin curvilinear stem slot portion that terminates in a second appliance operating position seat that is substantially level with said wall slot stem part pin seat, whereby, when at each bracket said pins are seated in said appliance first operation position seats of the respective wall slot means, the appliance is in its first operating position, and when at each bracket said pins are seated in said second appliance operating position seats of the respective wall slot means, the appliance is in its second operating position, with said retractable pins being retracted and then released to shift them between said separate slots of the respective walls defining said retractable pin slot means, with said fixed pins seated in the respective first and second appliance operating seats of said fixed pin slot means, and with said retractable pins free of both their slots of their slot means, the appliance may be disposed in one of its retracted positions, and with the weight of the appliance providing a rotational bias of the appliance in the direction of the rest, on release of said retractable pins, for assisting in the changing of the appliance between operating positions.

2. The improvement set forth in claim 1 wherein:

said slot means for the respective fixed pins includes, in the upper horizontal portions thereof, identical downwardly indented pin seats intermediate said first appliance operation position seats and the connection to said curvilinear stem slot portions thereof, said downwardly indented seats being spaced from said first operating positions of said fixed pin slot means a distance substantially equalling that of the length of said toe portions of said slot means for said retractable pins, whereby when said fixed pins are seated in said indented pin seats and said retractable pins are free of both their slots of their slot means, the appliance may be disposed to position said retractable pins in closed perimeter horizontal slots therefor for lateral shifting of the appliance to said first operating position.

3. The improvement set forth in claim 2 wherein:

the appliance is located on the base such that when said fixed and retractable pins are in said seats defining the second operating position of the appliance, swing movement of the appliance toward the rest disposes said fixed pins in gravity biased relation against said bracket horizontal walls to expose the appliance front side for access from the top of the shell.

4. In an appliance assembly that includes a base on which the appliance is mounted, and means for adjustably mounting the base between confronting supports for movement between upstanding positions at different levels in which the appliance base is horizontally disposed and the appliance is disposed in upright operable positioning, and retracted positions in which the appliance is sidewise disposed, the improvement wherein:

the mounting of the appliance on the base, and said mounting means, comprises:

the base having a pair of aligned pins fixed to said base adjacent the front of the appliance, with one of said fixed pins projecting from one end of the base and the other of said fixed pins projecting from the other end of the base, with the base having mounted thereon adjacent the other side of the base a pair of aligned retractable pins, with one of said retractable pins projecting from said one end of the base and the other of said retractable pins projecting from said other end of the base, said retractable pins being mounted for movement axially thereof toward each other to dispose them in withdrawn positions relative to the base ends, and including means for resiliently biasing same to their respective projecting positions and handle means for simultaneously moving same to their withdrawn positions, with the appliance being fixed to the base above said pins, and including a first bracket secured to one of the supports in supporting relation to those said pins that are at one end of the base, and a second bracket secured to the other of the supports in supporting relation to those of said pins that are at the other end of the base, said brackets being mounted in confronting relation and each including a vertical wall, and said walls being in substantial parallelism and each being formed to define slot means in which said pins at either end of the base are received to support the appliance and base from the supports, said slot means of one of said walls being a mirror image of said slot means of the other of said walls, said slot means for each of said walls comprising, for the respective fixed pins, an upper horizontal slot portion having a first appliance operating position seat adjacent a vertical stop surface adjacent the front of the appliance, with said slot upper horizontal portion being open and connected to a curvilinear slot stem portion that arcs downwardly below said slot upper portion to a second appliance operating position pin set substantially vertically aligned with said horizontal slot portion seat, said brackets each including a horizontal wall rigid with respect to the respective brackets and disposed above said slot means slot portion, said slot means for each of said walls comprising, for the respective retractable pins, an upper closed perimeter horizontal slot that is substantially level with said wall upper horizontal slot portions of said walls for said fixed pins, and having closed ends, with the end of same that is closest to said wall upper horizontal slot portion of the respective brackets forming a first appliance operation position seat, and an elongate curvilineaf closed perimeter slot separated from and below the said closed perimeter upper horizontal slot of the respective walls and having its upper end substantially aligned with the other end of said closed perimeter upper slot and arcing downwardly to substantial vertical alignment with said closed perimeter slot seat, and thence defining a toe portion extending away from and rearwardly of the wall fixed pin curvilinear stem slot portion that terminates in a second appliance operating position seat that is substantially level with said wall slot stem part pin seat, and including stationary rest defining for supporting the appliance in its retracted positions, whereby, when at each bracket said pins are seated in said appliance first operation position seats of the respective wall slot means, the appliance is in its first operating position, and when at each bracket said pins are seated in said second appliance operating position seats of the respective wall slot means, the appliance is in its second operating position, with said retractable pins being retracted and then released to shift them between said separate slots of the respective walls defining said retractable pin slot means, with said fixed pins seated in the respective first and second appliance operating seats of said fixed pin slot means, and with said retractable pins free of both their slots of their slot means, the appliance may be disposed in one of its retracted positions, and with the weight of the appliance providing a rotational basis of the appliance in the direction of said rest means, on release of said retractable pins, for assisting in the changing of the appliance between operating positions.

5. The improvement set forth in claim 4 wherein:

said slot means for the respective fixed pins includes, in the upper horizontal portions thereof, identical downwardly indented pin seats intermediate said first appliance operation position seats and the connection to said curvilinear stem slot portions thereof, said downwardly indented seats being spaced from said first operating positions of said fixed pin slot means a distance substantially equallying that of the length of said toe portions of said slot means for said retractable pins, whereby when said fixed pins are seated in said indented pin seats and said retractable pins are free of both their slots of their slot means, the appliance may be disposed to position and retractable pins in said closed perimeter horizontal slots therefor for lateral shifting of the appliances to said first operating position.

6. The improvement set forth in claim 4 wherein:

the appliance is located on the base such that when said fixed and retractable pins are in said seats defining the second operating position of the appliance, swing movement of the appliance rearwardly disposes said fixed pins in gravity biased relation against said bracket horizontal walls to expose the appliance front side for access from the front of same.

7. The improvement set forth in claim 4 wherein:

said rest means comprises a stationary component disposed rearwardly of the appliance and engage by the appliance when the appliance is in its retracted positions.

8. The improvement set forth in claim 4 wherein:

said closed perimeter slot of said bracket for said retractable pins including a cam surfacing adjacent the upper ends of same for camming said retractable pins to their retracted positions on motion of the appliance to return said retractable pins from said lower seat thereof to said upper seat thereof.

9. The improvement set forth in claim 4 wherein:

said brackets adjacent their lower ends include slanted cam surfacings for shifting said retractable pins to their retracted positions when the appliance is shifted upwardly of said rest means.

10. The improvement set forth in claim 4 wherein:

the appliance is a sewing machine, and the supports are connected together to form a shell that receives the sewing machine in said retracted positions thereof.

* * * * *